US005259898A

United States Patent [19]

Tauber et al.

[11] Patent Number: 5,259,898

[45] Date of Patent: Nov. 9, 1993

[54] ALLOY FOR SPECTACLE WIRE FRAMES AND ELECTRONIC COMPONENT PARTS

[75] Inventors: Klaus Tauber, Biebertal; Wolfgang Brandstaetter, Oberursel; Erich Dommer, Heuchelheim; Juergen Fackert, Steffenberg; Bruno Rechtziegel, Heuchelheim, all of Fed. Rep. of Germany

[73] Assignee: Berkenhoff GmbH, Heuchelheim, Fed. Rep. of Germany

[21] Appl. No.: 808,026

[22] Filed: Dec. 13, 1991

[30] Foreign Application Priority Data

Dec. 22, 1990 [DE] Fed. Rep. of Germany ..... 9017408

[51] Int. Cl.[5] ..... C22C 9/04

[52] U.S. Cl. ..... 148/434; 148/435; 420/481; 420/485; 420/487; 420/496

[58] Field of Search ..... 148/434, 435; 420/481, 420/485, 487, 496

[56] References Cited

U.S. PATENT DOCUMENTS

| | | | |
|---|---|---|---|
| 2,224,095 | 12/1940 | Barry | 138/47 |
| 4,171,972 | 10/1979 | Bates et al. | 420/481 |
| 4,452,757 | 6/1984 | Kawauchi et al. | 420/471 |
| 5,045,411 | 9/1991 | Taylor et al. | 420/481 |

FOREIGN PATENT DOCUMENTS 501870 6/1919 France .

OTHER PUBLICATIONS

Sato, *Sumitomo Light Metal Technical Reports,* vol. 5, No. 4 (Oct. 1964), pp. 25-36.

Nagasaki, et al. "Effects of Additives on Dezincification of oc-Brasses at High Temperature in Vacuum", *Journal of the Japan Institute of Metals,* vol. 34, No. 3 (Mar. 1970), pp. 343-347.

Otsue and Sato, *Sumitomo Light Metal Technical Reports,* vol. 1, No. 1 (Jan. 1960), pp. 22-29.

Sato, *Sumitomo Light Metal Technical Reports,* vol. 5, No. 1 (Jan. 1964), pp. 2-8.

Sato, *Sumitomo Light Metal Technical Reports,* vol. 5, No. 2 (Apr. 1964), pp. 27-34.

Sato, *Sumitomo Light Metal Technical Reports,* vol. 5, No. 3 (Jul. 1964), pp. 51-56.

*Primary Examiner*—R. Dean
*Assistant Examiner*—Robert R. Koehler
*Attorney, Agent, or Firm*—Flynn, Thiel, Boutell & Tanis

[57] ABSTRACT

An alloy, in particular for the manufacture of spectacle frames, and a spectacle wire or a spectacle frame and connecting wires for electronic component parts manufactured using the alloy of the invention. In order to obtain good mechanical characteristics, for example, of the spectacle frame at low expense, the invention provides the following alloy which, in percentage by weight, is composed as follows: 63-78% copper, 3-7% nickel, 1-3% iron, 0.01-0.20% phosphorus, the remainder being zinc.

6 Claims, No Drawings

ALLOY FOR SPECTACLE WIRE FRAMES AND ELECTRONIC COMPONENT PARTS

FIELD OF THE INVENTION

The invention relates to an alloy which, on the one hand, is used for the manufacture of spectacle frames, in particular for the manufacture of bows and, on the other hand, is used as a connecting wire for electronic component parts. The invention relates furthermore to spectacle frames which are manufactured using the alloy, and to spectacle wire used for the manufacture of the bows.

BACKGROUND OF THE INVENTION

It is necessary during the manufacture of metallic spectacle frames to choose both the design and also the material in such a manner that the finished spectacle frame has the very highest degree of strength and is not deformed during practical use. Deformation of the spectacle frame can occur both in the area of the frame for the glasses and also in the area of the bows and always has the result that the spectacle no longer fits correctly and the user tries to bend the spectacle back into its original shape.

In order to prevent such deformation of the spectacle frame, various alloys have been developed and which are described, for example, in the DE-OS 26 26 251 and DE-OS 38 34 186.

The known alloys have the disadvantage that they are not suited or are only suited to a limited degree to meet certain demands since the material does not have a sufficient strength or resilient characteristics or loses strength during the manufacturing process, for example, during soldering or welding operations. A further disadvantage of the known alloys is that they have a very high nickel content. Since the percentage of population having allergies against nickel is significantly increased, many of these alloys cannot be used or can only be used at considerable expense, for example, by applying additional coatings. Additional disadvantages of the known alloys are caused by their relatively high price.

Connecting wires for electronic component parts must have a low electric conductivity and thus must have a low heat conductivity in order to achieve a protection against destructive temperatures for the electronic component parts during connecting operations, as for example during soldering.

The basic purpose of the invention is to provide an alloy for spectacles or connecting wires which, while being inexpensive to manufacture and having a high mechanical strength, has a low nickel content and a low heat conductivity.

The purpose is attained according to the invention by an alloy which, in percentage by weight, has the following components: 63–78% copper, 3–7% nickel, 1–3% iron, 0.01–0.20% phosphorus, the remainder being zinc.

The alloy of the invention is distinguished by a number of significant advantages. In contrast to the alloys known from the state of the art, the alloy of the invention has a very low nickel content of only 3–7%, while the alloy described in DE-OS 26 26 251 can have a nickel content of up to 26%, similar to the alloy of DE-OS 38 34 186, which provides a nickel content of 17–25%.

A further, significant advantage of the alloy of the invention is that same has a higher recrystallization temperature than the presently known spectacle alloys.

Thus, it is possible to weld or solder the alloy without noticeably influencing the elastic characteristics. The resilient behavior of the alloy, which is of a great importance, in particular in the case of spectacle bows, thus continues to exist also in the welding or soldering areas. Such critical areas are in particular those where the spectacle bow is connected to the hinge part. Common alloys have the tendency to loose strength in this connecting area with the result that the spectacle frame bends easily during practical use.

Furthermore, the alloy of the invention can be easier polished thus enhancing the total appearance of the spectacle frame.

The alloy of the invention is also distinguished by a better optical appearance and has thereby in particular a golden effect so that a thinner layer is needed when a gold coating is applied.

The alloy of the invention has fantastic spring characteristics, the iron and phosphorus content resulting in an increased strength compared with the presently known alloys.

The alloy of the invention has a low electric conductivity of 5.5–6.5 $m/OHM \times mm^2$ (Siemens) and a low heat conductivity of 38–44 $W/m \times k$.

The alloys according to the invention are formed according to conventional alloying processes. Alloys containing the desired metal constituents can be melted in accordance with their alloying contributions with, if necessary, true alloy manufacturing scrap being able to be utilized. The casting is done either by means of semi-continuous dowel or fully continuous wire extrusion systems. The subsequent forming is done by means of extrusion presses or continuous rolling. The wire is then drawn and annealed, with the annealing treatments taking place at temperatures in the range of 700° K. to 950° K. The spectacle frames are manufactured of such a prefabricated wire material.

In addition, in the use of this alloy a blocking layer is not needed, as with commonly used Cu-Sn+P-alloys because of their tendency of forming brittled whisker growth in the connecting layers, since the claimed alloys contain less P-parts than the commercially available CuSn-bronze alloys and obviously have a lower mobility of the P-atoms because of the formation of the $Fe_3$ P-phase present as deposit. The connecting wires, which are "bare" or are coated directly with Sn or SnPb can be connected—soldered—essentially under the same conditions as the up to now mainly utilized CuSn-wires.

A preferred further development of the invention provides that the alloy has the following components (in percentage by weight): 64–68% copper, 4–5% nickel, 1–2% iron, 0.01–0.05% phosphorus, the remainder being zinc. It can also be particularly advantageous when the alloy, also in percentage by weight, is composed in the following manner: 65% copper, 4.6% nickel, 1.2% iron, 0.02% phosphorus, the remainder being zinc.

The purpose is also attained by an alloy which has the following components, in percentage by weight: 74–78% copper, 3.5–4.5% nickel, 1–2% iron, 0.01–0.05% phosphorus, the remainder being zinc.

The last mentioned alloy of the invention is distinguished also by the initially mentioned advantages.

The alloys of the invention can be processed preferably into wire material having different cross sections from which individual parts for a spectacle frame can be manufactured in a conventional manner. Thus, it is possible without any problems to utilize the alloy of the invention to manufacture common spectacle frames. In particular the necessary connecting processes and connecting steps can be carried out without influencing the advantageous characteristics of the alloys of the invention.

The invention is not to be limited to the illustrated exemplary embodiments, rather many possibilities for modifications exist within the scope of the invention for the man skilled in the art.

The embodiments of the invention in which an exclusive property or privilege is claimed are defined as follows:

1. An alloy useful for spectacle frames and electrical connecting wires for connecting electronic components consisting essentially of, in percentage by weight:

| | |
|---|---|
| Cu | 64-68%; |
| Ni | 4-5%; |
| Fe | 1-2%; |

-continued

| | |
|---|---|
| P | 0.01-0.05%; |

and the remainder being Zn.

2. The alloy according to claim 2, consisting essentially of, in percentage by weight:

| | |
|---|---|
| Cu | 65%; |
| Ni | 4.6%; |
| Fe | 1.2%; |
| P | 0.02%; |

and the remainder being Zn.

3. A spectacle wire frame manufactured by using an alloy according to claim 1.

4. A connecting wire for electronic component parts manufactured by using an alloy according to claim 1.

5. A spectacle wire frame manufactured by using an alloy according to claim 2.

6. A connecting wire for electronic component parts manufactured by using an alloy according to claim 2.

* * * * *

UNITED STATES PATENT AND TRADEMARK OFFICE

CERTIFICATE OF CORRECTION

PATENT NO. : 5 259 898

DATED : November 9, 1993

INVENTOR(S) : Klaus TAUBER et al

It is certified that error appears in the above-identified patent and that said Letters Patent is hereby corrected as shown below:

Column 4, line 6, change "claim 2" to ---claim 1---.

Signed and Sealed this

Fourteenth Day of June, 1994

*Attest:*

*Attesting Officer*

Bruce Lehman

BRUCE LEHMAN

*Commissioner of Patents and Trademarks*